US008862039B2

(12) United States Patent
Yoshida et al.

(10) Patent No.: US 8,862,039 B2
(45) Date of Patent: Oct. 14, 2014

(54) IMAGE FORMING APPARATUS

(75) Inventors: Tsuguhiro Yoshida, Yokohama (JP); Akihiko Uchiyama, Mishima (JP); Hiroyuki Munetsugu, Yokohama (JP); Takaaki Akamatsu, Yokohama (JP); Toshihiko Takayama, Kawasaki (JP); Yuya Kojima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 13/588,961

(22) Filed: Aug. 17, 2012

(65) Prior Publication Data

US 2013/0064583 A1 Mar. 14, 2013

(30) Foreign Application Priority Data

Aug. 22, 2011 (JP) ..... 2011-180547

(51) Int. Cl.
*G03G 15/20* (2006.01)

(52) U.S. Cl.
CPC ..... *G03G 15/2025* (2013.01); *G03G 15/2075* (2013.01); *G03G 2215/00531* (2013.01); *G03G 2215/0132* (2013.01)
USPC ..... 399/327; 399/67; 399/71

(58) Field of Classification Search
CPC ..... G03G 15/2025; G03G 15/2075; G03G 2215/00531
USPC ..... 399/67, 71, 327
See application file for complete search history.

(56) References Cited

U.S. PATENT DOCUMENTS

| | | | | |
|---|---|---|---|---|
| 5,865,121 | A * | 2/1999 | Testardi et al. | 399/327 |
| 2009/0195582 | A1* | 8/2009 | Iriguchi | 347/14 |
| 2010/0260523 | A1* | 10/2010 | Nishida et al. | 399/327 |
| 2012/0148286 | A1* | 6/2012 | Hirai et al. | 399/71 |

FOREIGN PATENT DOCUMENTS

| | | | |
|---|---|---|---|
| JP | 3-58074 | A | 3/1991 |
| JP | 2000-047509 | A | 2/2000 |
| JP | 2010-145835 | A | 7/2010 |

* cited by examiner

*Primary Examiner* — Ryan Walsh
(74) *Attorney, Agent, or Firm* — Canon U.S.A., Inc. IP Division

(57) ABSTRACT

An image forming apparatus, which is configured to form an image on a sheet, includes an image forming unit configured to form an unfixed toner image on the sheet, and a fixing unit configured to fix the unfixed toner image to the sheet by heating the sheet bearing the unfixed toner image while conveying the sheet by a fixing nip portion. The image forming apparatus can perform a cleaning mode for cleaning the fixing unit by conveying a sheet with an unfixed toner image for cleaning formed thereon by the fixing nip portion. At a time of the cleaning mode, the image forming unit forms the unfixed toner image for cleaning on a sheet surface opposite from a sheet surface where the unfixed toner image is formed at a time of image formation.

22 Claims, 6 Drawing Sheets

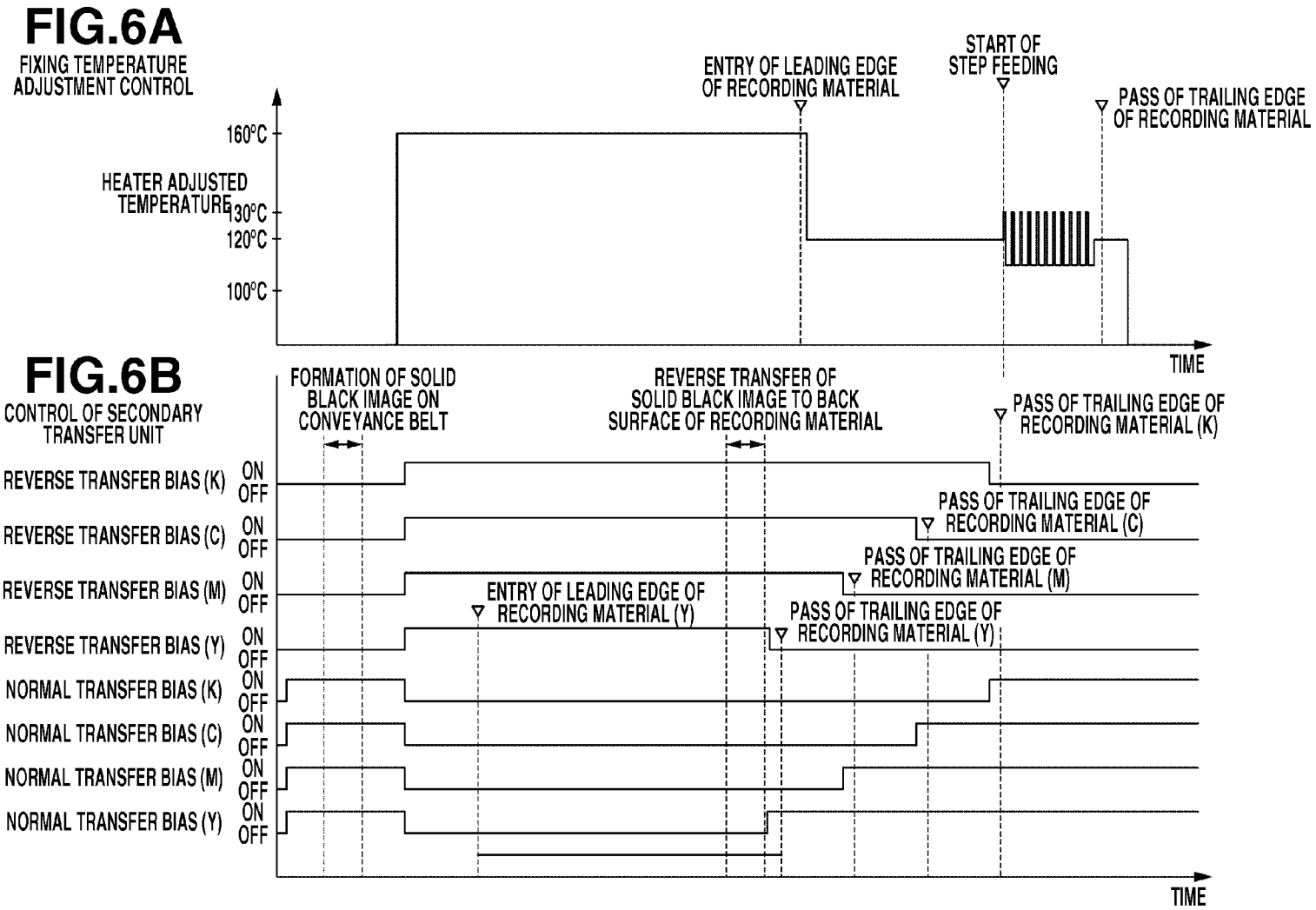
FIG.6A
FIXING TEMPERATURE ADJUSTMENT CONTROL
HEATER ADJUSTED TEMPERATURE
160°C
130°C
120°C
100°C
ENTRY OF LEADING EDGE OF RECORDING MATERIAL
START OF STEP FEEDING
PASS OF TRAILING EDGE OF RECORDING MATERIAL
TIME
FIG.6B
CONTROL OF SECONDARY TRANSFER UNIT
FORMATION OF SOLID BLACK IMAGE ON CONVEYANCE BELT
REVERSE TRANSFER OF SOLID BLACK IMAGE TO BACK SURFACE OF RECORDING MATERIAL
ENTRY OF LEADING EDGE OF RECORDING MATERIAL (Y)
PASS OF TRAILING EDGE OF RECORDING MATERIAL (Y)
PASS OF TRAILING EDGE OF RECORDING MATERIAL (M)
PASS OF TRAILING EDGE OF RECORDING MATERIAL (C)
PASS OF TRAILING EDGE OF RECORDING MATERIAL (K)
REVERSE TRANSFER BIAS (K)
REVERSE TRANSFER BIAS (C)
REVERSE TRANSFER BIAS (M)
REVERSE TRANSFER BIAS (Y)
NORMAL TRANSFER BIAS (K)
NORMAL TRANSFER BIAS (C)
NORMAL TRANSFER BIAS (M)
NORMAL TRANSFER BIAS (Y)
ON
OFF
TIME

IMAGE FORMING APPARATUS

BACKGROUND OF THE INVENTION

1. Field of the Invention

The present invention relates to an image forming apparatus such as an electrophotographic copying machine or printer.

2. Description of the Related Art

A fixing unit in an electrophotographic image forming apparatus such as a copying machine, a printer, and a facsimile apparatus is widely used to fix an unfixed toner image transferred on a sheet such as a transfer sheet and an overhead projector (OHP) sheet onto the sheet. The fixing unit includes a heating member, and a pressure member forming a fixing nip portion together with the heating member. Generally, the fixing unit heats a sheet which bears an unfixed toner image while conveying the sheet by the fixing nip portion, thereby heat-fusing the unfixed toner image to fix it to the sheet.

As the fixing unit, it is ideal that the entire unfixed toner image on the sheet is heat-fused by the heating member to be fixed to the sheet. However, actually, toner remaining unfused or excessively fused toner may be offset from the sheet surface to the heating member. The toner offset from the sheet surface to the surface of the heating member may be transferred from the surface of the heating member to the surface of the pressure member, thereby causing dirt of the surface of the pressure member.

Further, for example, in a heat roller fixing unit or a film heating fixing unit, dirt is more easily accumulated on the surface of the pressure member than on the heating member. The fixing unit heats the surface of the heating member that contacts the unfixed tonner image bearing surface of a sheet to the softening temperature of the toner or higher, to fix the unfixed toner image to the sheet at the time of printing. Therefore, the toner offset to the surface of the heating member to be attached thereto is heated to the softening temperature of the toner or higher at the time of the next printing, and is discharged to the surface of a sheet being conveyed through the fixing unit. Further, paper dusts such as fibers and calcium carbonate of paper, which are attached to the surface of the heating member, are also discharged onto the sheet by adhering to the toner discharged from the surface of the heating member to the surface of the sheet. In this way, the surface of the heating member can easily avoid being cumulatively contaminated.

On the other hand, the surface of the pressure member does not come into contact with the unfixed tonner image bearing surface of the sheet, and therefore the surface of the pressure member does not necessarily have to be heated to the softening temperature of the toner or higher even at the time of printing. Further, it is also desirable in terms of energy saving to refrain from increasing the temperature of the surface of the pressure member more than necessary. Accordingly, in most cases, the temperature of the surface of the pressure member is maintained at a temperature equal to or lower than the softening temperature of the toner at the time of printing. Therefore, the toner attached to the surface of the pressure member is hardly heated to a temperature equal to or higher than the softening temperature so as to have a weak adhesion force to the sheet, whereby the toner on the surface of the pressure member is difficult to be discharged onto a sheet even when the sheet is conveyed through the fixing nip portion at the time of printing.

Further, in a case where paper dusts generated from a sheet is attached to the surface of the pressure member together with the toner, the stickiness is reduced compared to a case where only the toner is attached to the surface of the pressure member, whereby the toner in this case is further difficult to be discharged onto the sheet. For this reason, toner and paper dusts are easily left on the surface of the pressure member, and then are easily accumulated thereon. This phenomenon is especially noticeable at an image forming apparatus lacking an automatic two-sided printing function, according to which a sheet is turned over within the image forming apparatus and then is conveyed to the transfer unit to realize two-sided printing, because, in such an image forming apparatus, the surface of the sheet where the toner is printed rarely comes into contact with the surface of the pressure member.

Japanese Patent Application Laid-Open No. 2000-047509 discusses a method for cleaning a pressure roller by sandwiching a solid white sheet by a fixing nip portion and conveying the sheet while repeating a rotation and a stop. Especially, above method increases the temperature of the surface of the pressure member so that toner contained in dirt on the surface of the pressure member is heated to a temperature equal to or hire than the softening temperature at the time of the stop, thereby increasing the adhesion force, to the sheet, of the dirt to facilitate a discharge of the dirt on the surface of the pressure member onto the sheet.

However, in a case where the dirt attached to the surface of the pressure member contains only a small percentage of the toner, the stickiness as the entire dirt is kept small even if the toner in the dirt is heated to a temperature equal to or higher than the softening temperature to increase the stickiness of the toner in the dirt as described above. Therefore, it is impossible to acquire a sufficient adhesion force, to the surface of the sheet, of the dirt attached to the surface of the pressure member, thereby raising such a problem that the cleaning performance may be insufficient.

Japanese Patent Application Laid-Open No. 3-58074 discusses a method for cleaning a pressure member, in which a sheet with a solid image formed thereon is printed as a cleaning paper for the pressure member to be discharged to the outside of an image forming apparatus, and a user turns over the sheet and provides the sheet through the image forming apparatus again.

Actually, according to the cleaning method discussed in Japanese Patent Application Laid-Open No. 3-58074, even in a case where dirt on the pressure roller contains only a small percentage of toner, it is possible to acquire a large adhesion force of the dirt on the pressure roller to the sheet, and therefore an improved cleaning performance can be expected.

However, when an image forming apparatus does not have the automatic two-sided printing function, according to which a sheet is turned over within the image forming apparatus and then is conveyed to the transfer unit to realize two-sided printing, this method requires a user to participate in the process, thereby raising a problem of deteriorated usability.

SUMMARY OF THE INVENTION

The present invention is directed to an image forming apparatus, which does not have the automatic two-sided printing function, according to which a sheet is turned over within the image forming apparatus and then is conveyed to the transfer unit to realize two-sided printing, having a sufficient cleaning performance and capable of cleaning a pressure roller while maintaining excellent usability.

According to a first aspect of the present invention, an image forming apparatus, which is configured to form a toner image on a sheet, includes an image forming unit configured to form an unfixed toner image on the sheet, and a fixing unit configured to fix the unfixed toner image to the sheet by heating the sheet bearing the unfixed toner image while conveying the sheet by a fixing nip portion. The image forming apparatus can perform a cleaning mode for cleaning the fixing unit by conveying a sheet with an unfixed toner image for cleaning formed thereon by the fixing nip portion. The image forming unit is configured, at a time of the cleaning mode, to form the unfixed toner image for cleaning on a sheet surface opposite to a sheet surface where the unfixed toner image is formed at a time of image formation.

According to a second aspect of the present invention, an image forming apparatus, which is configured to form a toner image on a sheet, includes an image forming unit configured to form an unfixed toner image on the sheet, and a fixing unit configured to include a first fixing member and a second fixing member forming a fixing nip portion together with the first fixing member. The fixing unit is configured to fix the unfixed toner image to the sheet by heating the sheet with the unfixed toner image formed thereon while conveying the sheet by the fixing nip portion. The unfixed toner image formed on the sheet at the time of image formation is in contact with the first fixing member in an unfixed state but is out of contact with the second fixing member in an unfixed state. The image forming apparatus can perform a cleaning mode for cleaning the second fixing member by conveying a cleaning sheet by the fixing nip portion. An unfixed toner image for cleaning formed on the cleaning sheet at the time of the cleaning mode is in contact with the second fixing member in an unfixed state.

According to a third aspect of the present invention, a cleaning method for cleaning a fixing unit by conveying a sheet by a fixing nip portion includes forming an unfixed toner image for cleaning on a cleaning sheet, and conveying the cleaning sheet by the fixing nip portion in such a manner that the unfixed toner image for cleaning is in contact with a fixing member, which forms the fixing nip portion and is not in contact with an unfixed toner image at a time of image formation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 6A and 6B illustrates a cleaning mode according to the third exemplary embodiment of the present invention.

DESCRIPTION OF THE EMBODIMENTS

Various exemplary embodiments, features, and aspects of the invention will be described in detail below with reference to the drawings.

Figure 1A:
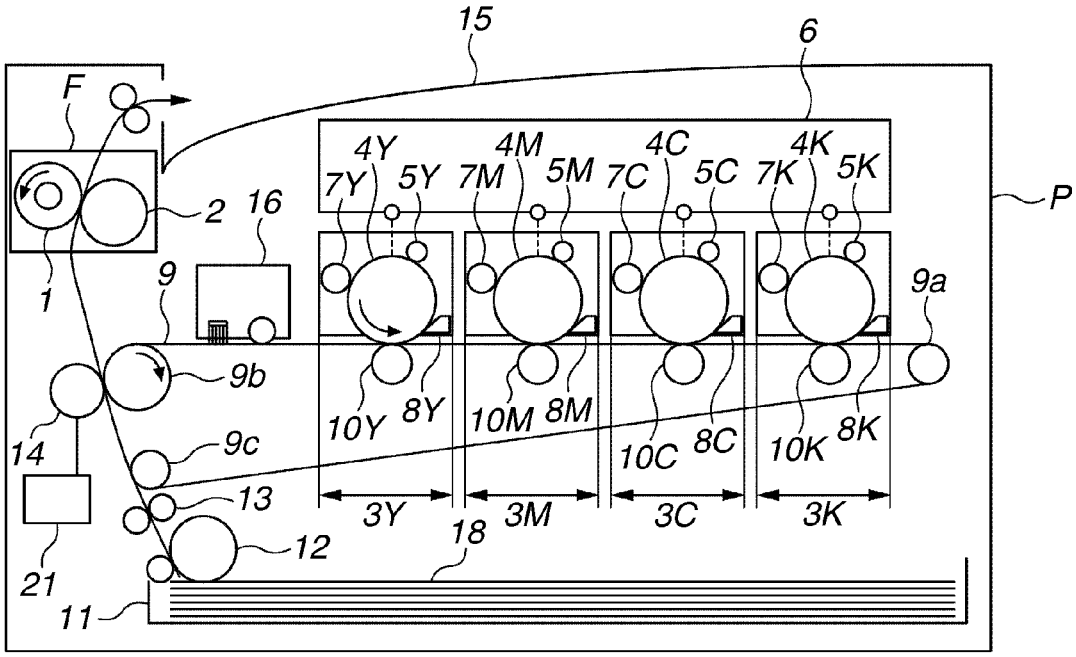
FIGS. 1A and 1B illustrate an image forming apparatus according to a first exemplary embodiment of the present invention.

A first exemplary embodiment will be described. An image forming apparatus used in the first exemplary embodiment of the present invention will be described with reference to the drawings. FIG. 1A illustrates an image forming apparatus P used in the first exemplary embodiment.

The image forming apparatus P includes four image forming stations 3Y, 3M, 3C, and 3K, which are substantially linearly arranged. Among the four image forming stations 3Y, 3M, 3C, and 3K, the image forming station 3Y forms a yellow (hereinafter abbreviated as "Y") image. The image forming station 3M forms a magenta (hereinafter abbreviated as "M") image. The image forming station 3C forms a cyan (hereinafter abbreviated as "C") image. The image forming station 3K forms a black (hereinafter abbreviated as "K") image.

The image forming stations 3Y, 3M, 3C, and 3K include drum-type electrophotographic photosensitive members (hereinafter referred to as "photosensitive drums") 4Y, 4M, 4C, and 4K as a first image bearing member, and charging rollers 5Y, 5M, 5C, and 5K as a charging unit, respectively. Further, the image forming stations 3Y, 3M, 3C, and 3K include development devices 7Y, 7M, 7C, and 7K as a development unit, and cleaning devices 8Y, 8M, 8C, and 8K as a photosensitive drum cleaning unit, respectively.

Further, the image forming apparatus P includes an exposure device 6 as an exposure unit. The image forming stations 3Y, 3M, 3C, and 3K may include toner containers that contain toner, respectively, and may be configured as cartridges (hereinafter referred to as "toner cartridges") detachably attached to the image forming apparatus P and replaceable by a user.

Next, an image formation process will be described. When an image is formed, at the image forming station 3Y, the photosensitive drum 4Y is rotated in the direction indicated by the arrow. First, the outer circumferential surface (the surface) of the photosensitive drum 4Y is uniformly charged by the charging roller 5Y, and the charged surface of the surface of the photosensitive drum 4Y is illuminated with laser light according to image information by the exposure device 6, thereby forming an electrostatic latent image. The latent image is visualized as a Y toner image by the development device 7Y with use of Y toner. As a result, a Y toner image is formed on the surface of the photosensitive drum 4Y.

A similar image formation process is also performed at the image forming stations 3M, 3C, and 3K. As a result, an M toner image is formed on the surface of the photosensitive drum 4M, a C toner image is formed on the surface of the photosensitive drum 4C, and a K toner image is formed on the surface of the photosensitive drum 4K. In the first exemplary embodiment, the photosensitive drums 4Y, 4M, 4C, and 4K are negatively chargeable organic photo conductors, and toner used in the first exemplary embodiment is toner having negative polarity.

An endless intermediate transfer belt 9, as a second image bearing member disposed along the direction in which the image forming stations 3Y, 3M, 3C, and 3K are arranged, is stretched by a driving roller 9*a*, a driven roller 9*b*, and an assist roller 9*c*. The driving roller 9*a* rotates in the direction indicated by the arrow in FIG. 1. Above configuration causes the intermediate transfer belt 9 to be rotated and conveyed along the image forming stations 3Y, 3M, 3C, and 3K at a process speed, which will be described below.

The toner images of the respective colors are transferred to be sequentially superimposed on the outer circumferential surface (surface) of the intermediate transfer belt 9 by primary transfer rollers 10Y, 10M, 10C, and 10K as a primary transfer unit disposed opposite to the photosensitive drums 4Y, 4M, 4C, and 4K across the intermediate transfer belt 9. As a result, a full-color toner image is formed on the surface of the intermediate transfer belt 9.

Transfer remaining toner, which remains on the surfaces of the photosensitive drums 4Y, 4M, 4C, and 4K after the primary transfer, is removed by a not-illustrated cleaning blade disposed each of the cleaning devices 8Y, 8M, 8C, and 8K. In this way, the photosensitive drums 4Y, 4M, 4C, and 4K become ready for the next image formation.

In the meantime, sheets 18 stacked and contained in a sheet feeding cassette 11 disposed at the lower portion of the image forming apparatus P are separated and fed one by one from the sheet feeding cassette 11 by a sheet feeding roller 12, and are conveyed to a registration roller pair 13. The registration roller pair 13 conveys the sheet 18 to a secondary transfer nip portion, which is formed by the intermediate transfer belt 9 and a secondary transfer roller 14, in synchronization with the toner image formed on the intermediate transfer belt 9. When the sheet 18 is conveyed through the secondary transfer nip portion, the full-color toner image is secondarily transferred from the surface of the intermediate transfer belt 9 to the sheet 18.

After that, the sheet 18, which bears unfixed tonner, is conveyed to a fixing unit F, and is heated and pressed by the fixing unit F, whereby the toner image is fixed onto the sheet 18. After that, the sheet 18 is discharged from the fixing unit F to a discharge tray 15 outside the image forming apparatus P. Transfer remaining tonner, which remains on the surface of the intermediate transfer belt 9 after the secondary transfer, is removed by a cleaning device 16 of the intermediate transfer belt 9. In this way, the intermediate transfer belt 9 becomes ready for the next image formation.

Next, the configuration of the secondary transfer unit and the secondary transfer operation used in the first exemplary embodiment will be described. The secondary transfer unit includes the intermediate transfer belt 9, the driven roller 9*b* by which the intermediate transfer belt 9 is stretched, and the secondary transfer roller 14 as a rotatable secondary transfer unit disposed opposite to the driven roller 9*b* across the intermediate transfer belt 9. A power source 21, which can apply bipolar (both positive and negative polarity) voltage, is connected to the secondary transfer roller 14.

The length of the outer circumference of the intermediate transfer belt 9 is approximately 700 mm. The intermediate transfer belt 9 is made of a polyvinylidene fluoride (PVDF) material having a thickness of approximately 100 μm. The volume resistivity of the intermediate transfer belt 9 is approximately $5\times10^{10}$ Ωcm.

The secondary transfer roller 14 is constituted by a stainless-steel core having an outer diameter of 8 mm, and a foamed rubber formed around the core. The foamed rubber is made of a nitrile-butadiene rubber (NBR) hydrin material having a thickness of 7 mm. The outer diameter of the secondary transfer roller 14 is 22 mm. The resistance value of the secondary transfer roller 14 is $4\times10^{7}$Ω when a voltage of 1 kV is applied while it is pressed against an aluminum cylinder having a diameter of 30 mm, which is rotating at a speed of 30 rpm by a pressure of 1 kgf.

The secondary transfer roller 14 is driven by the intermediate transfer belt 9 to rotate, which is rotated and moved by being driven by the driving roller 9*a*. When a toner image is secondarily transferred from the intermediate transfer belt 9 to the sheet 18, bias having the reverse polarity of the toner is applied to the secondary transfer roller 14 by the power source 21.

After the completion of the secondary transfer, a voltage having positive polarity and a voltage having negative polarity (bipolar voltages) are alternately applied to the secondary transfer roller 14 several times by the power source 21, thereby performing a cleaning operation for discharging toner attached due to, for example, fog onto the intermediate transfer belt 9. The secondary transfer roller cleaning operation is performed during a break time between a print job and a print job.

In the present exemplary embodiment, an image forming unit is a configuration required to form a toner image on a sheet, i.e., the exposure device 6, the image forming stations 3Y, 3M, 3C, and 3K, the intermediate transfer belt 9, and the secondary transfer roller 14. Further, in the present exemplary embodiment, a time of image formation is a time when a toner image is formed on a sheet according to image information received by the image forming apparatus P from the outside of the image forming apparatus P.

Figure 2:
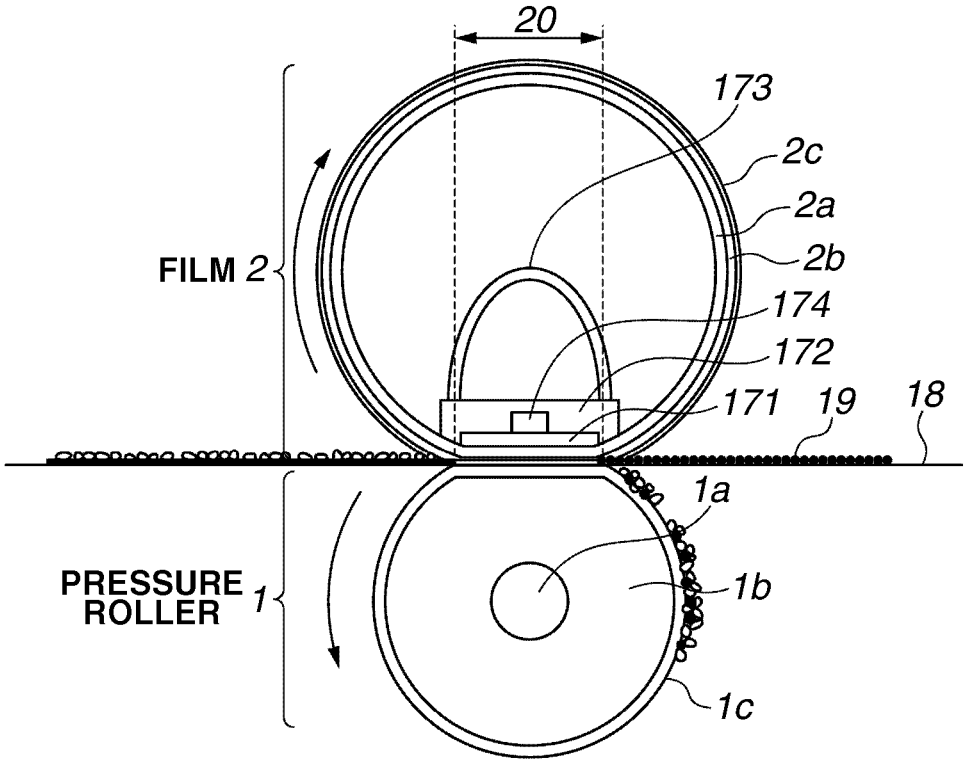
FIG. 2 illustrates a fixing unit according to the first exemplary embodiment of the present invention.

Next, the fixing unit F used in the first exemplary embodiment will be described. FIG. 2 illustrates the configuration of the fixing unit F according to the first exemplary embodiment. The fixing unit F includes a cylindrical film 2 as a first fixing member, and a heater 171 in contact with the inner circumferential surface of the film 2 for heating the film 2.

Further, the fixing unit F includes a pressure roller 1 as a second fixing member. The pressure roller 1 forms a fixing nip portion together with the heater 171 via the film 2. The fixing nip portion heats the sheet 18 bearing a toner image while conveying the sheet 18, thereby fixing the toner image onto the sheet 18.

The film 2 is in contact with an unfixed toner image on the sheet 18 in an unfixed state at the time of image formation. On the other hand, the pressure roller 1 is out of contact with the unfixed toner image on the sheet 18 in an unfixed state at the time of image formation.

The film 2 is a cylindrical member having an outer diameter of 18 mm. The film 2 includes a stainless-steel base layer 2*a*, and an elastic layer 2*b* disposed around the base layer 2*a*. The elastic layer 2*b* is made of a silicon rubber having a thickness of approximately 200 μm. Further, the film 2 includes a release layer 2*c* sequentially disposed around the elastic layer 2*b*. The release layer 2*c* is made of a tetrafluoroethylene-perfluoroalkyl vinyl ether copolymer (PFA) material having a thickness of 30 μm.

The pressure roller 1 includes a stainless-steel core la having an outer diameter of 13 mm, and an elastic layer 1*b* disposed around the core 1*a*, and a release layer 1*c* disposed around the elastic layer 1*b*. The elastic layer 1*b* is made of a silicon rubber having an outer diameter of approximately 3.5 mm. The release layer 1*c* is made of a PFA material having a thickness of approximately 50 μm. Therefore, in the first exemplary embodiment, the outer circumference of the pressure roller 1 is shorter than the outer circumference of the secondary transfer roller 14.

The heater 171 is a flat-plate ceramic heater. A heat resistor (not illustrated), which generates heat by energization, is formed on the surface of the heater 171 that is in contact with the film 2. Further, the surface of the heater 171 opposite from the surface of the heater 171 that is in contact with the film 2 is held by a heater holder 172. Further, a temperature detection element (temperature detection unit) 174 such as a thermistor is disposed on the surface of the heater 171 that is supported by the heater holder 172. An energization control unit (not illustrated) controls energization to a heat resistor layer (not illustrated) so that the temperature of the heater 171 reaches a target temperature based on an output signal from the temperature detection element 174. In this way, the surface of the film 2 is maintained at a predetermined adjusted temperature. The heater holder 172 is supported by a stay 173.

A drive control unit (not illustrated) rotates the pressure roller 1 according to a print instruction at a predetermined circumferential speed in the direction indicated by the arrow as illustrated in FIG. 2. The circumferential speed of the pressure roller 1 can be switched between a first circumferential speed faster than a process speed which is an image formation speed, and a second circumferential speed slower than the process speed. Stable conveyance of the sheet 18 is realized, regardless of a difference in the stiffness of the sheet 18, by selecting the first circumferential speed or the second circumferential speed according to the posture (loop amount) of the sheet 18 being conveyed between the secondary transfer nip portion and the fixing nip portion.

Now, the process speed will be described. The image forming apparatus P according to the first exemplary embodiment has three types of process speeds according to the type (thickness or grammage) of a sheet to be printed, and the respective first and second circumferential speeds of the pressure roller 1 vary depending on the process speed. The three types of process speeds are as follows: a full speed, which is 120 mm/sec; a half speed, which is 60 mm/sec; and a one-third speed, which is 40 mm/sec. The film 2 is rotated according to a rotation of the pressure roller 1 in the direction indicated by the arrow by a frictional force between the surface of the pressure roller 1 and the surface of the film 2 at the fixing nip portion 20.

After the rotations of the pressure roller 1 and the film 2 are stabilized and the temperature of the heater 171 is maintained at the adjusted temperature, the sheet 18, which bears an unfixed toner image 19, enters the fixing nip portion 20. The sheet 18 is conveyed while being sandwiched by the surface of the pressure roller 1 and the surface of the film 2 at the fixing nip portion 20. The heat of the film 2 and the pressure of the fixing nip portion 20 are applied to the sheet 18 during the conveyance, whereby the unfixed toner image 19 is heated and fixed to the surface of the sheet 18. The sheet 18 with the unfixed toner image 19 fixed thereto by heating is curvature-separated from the surface of the film 2 and is discharged from the fixing nip portion 20.

The film 2 is in contact with the unfixed toner image 19 on the sheet 18 in an unfixed state at the time of image formation. On the other hand, the pressure roller 1 is not in contact with the unfixed toner image 19 on the sheet 18 in an unfixed state at the time of image formation. Therefore, when the unfixed toner image 19 is heated and fixed to the sheet 18 at the fixing unit F at the time of image formation, toner remaining unfixed and unfused or excessively fused toner may be offset from the sheet surface to the film 2. The toner offset from the sheet surface to the surface of the film 2 may be transferred from the surface of the film 2 to the surface of the pressure member 1, thereby causing dirt on the surface of the pressure member 1.

In many cases, the temperature of the surface of the pressure roller 1 is maintained at equal to or lower than the softening temperature of the toner during heating fixation. Therefore, the toner attached to the surface of the pressure roller 1 is hardly heated to the softening temperature of the toner or higher so as to have a weak adhesion force to the sheet 18, whereby the toner on the surface of the pressure roller 1 is difficult to be discharged onto the sheet 18 even when the sheet 18 is conveyed through the fixing nip portion 20 during heating fixation.

Further, in a case where paper dusts generated from the sheet 18 are attached to the surface of the pressure roller 1 together with the toner, the stickiness is reduced compared to a case where only the toner attached to the surface of the pressure roller 1, whereby the toner in this case is further difficult to be discharged onto the sheet 18. For this reason, the toner and the paper dusts are easily left on the surface of the pressure roller 1, and then are easily accumulated thereon. This phenomenon is especially noticeable at an image forming apparatus lacking the automatic two-sided printing function, according to which the sheet 18 is turned over within the image forming apparatus where the surface of the sheet 18 with the toner image formed thereon would otherwise rarely be in contact with the surface of the pressure roller 1, and is then conveyed to the transfer unit to realize two-sided printing.

Therefore, the image forming apparatus P according to the present exemplary embodiment can perform a cleaning mode for cleaning the pressure roller 1, and the present exemplary embodiment is characterized by this cleaning mode. The cleaning mode, which will be described below, is a mode for forming a predetermined cleaning toner image on a cleaning sheet at predetermined timing, conveying this sheet by the fixing nip portion 20, thereby cleaning the fixing unit F. A time of the cleaning mode is a time when the cleaning mode is being performed, and is distinguished from the above-described time of image formation.

Now, the timing when the cleaning mode is performed will be described. Dirt on the pressure roller 1 is accumulated according to an increase in the number of sheets on which the fixation processing is performed (the number of sheets on which an image is formed). Therefore, one possible method is to automatically perform the cleaning mode each time the number of sheets on which the fixation processing is performed reaches a predetermined number.

Further, in a case where the image forming apparatus P includes a unit detachably attached to the image forming apparatus P and replaceable by a user, the cleaning mode may be automatically performed at the timing when this unit is replaced with a new unit. Especially, desirably, the cleaning mode may be performed at the timing when the toner cartridge is replaced with a new toner cartridge. This is because a predetermined amount of toner is necessary to form the cleaning toner image on the cleaning sheet, and enough toner can be secured immediately after the toner cartridge is replaced with a new one, thereby ensuring execution of the cleaning mode. In addition to that, the image forming apparatus P may be configured in such a manner that a user can perform the cleaning mode at arbitrary timing as necessary.

Figure 1B:
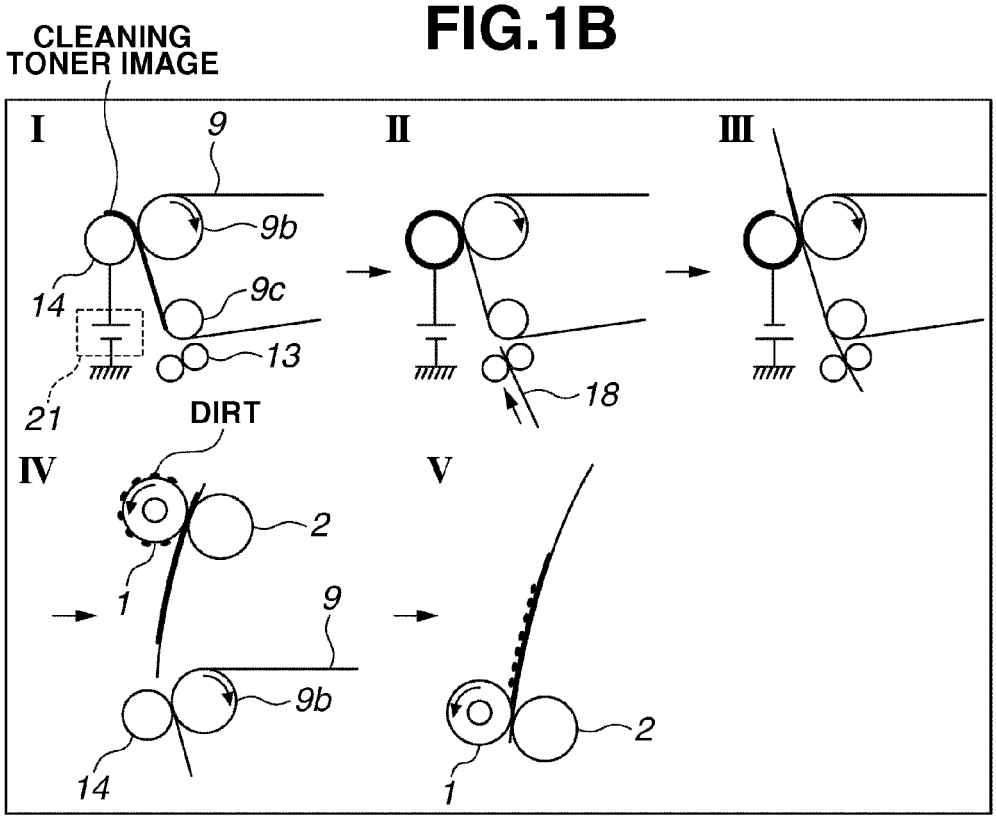

Next, the cleaning mode for cleaning the pressure roller 1 according to the first exemplary embodiment will be briefly described with reference to FIG. 1B. In the first exemplary embodiment, a solid black image as the cleaning toner image formed on the intermediate transfer belt 9 is transferred to the secondary transfer roller 14 by applying a voltage having the reverse polarity (positive polarity) to the toner to the secondary transfer roller 14 by the power source 21 (FIG. 1BI). Here, after the solid black image is transferred to the secondary transfer roller 14 (FIG. 1BII), the sheet 18 is conveyed to the secondary transfer nip portion (FIG. 1BIII). In such a state that the sheet 18 is conveyed while being sandwiched by the secondary transfer nip portion, the toner is reversely transferred to the surface of the sheet 18 that will be in contact with the pressure roller 1 by applying a voltage having the same polarity (negative polarity) as the toner to the secondary transfer roller 14 (FIG. 1BIV). After that, the pressure roller 1 is cleaned by conveying the sheet 18 with the toner image transferred to the surface that is in contact with the pressure roller 1 in a state sandwiched by the fixing nip portion 20 (FIG. 1BV).

Figure 3A:
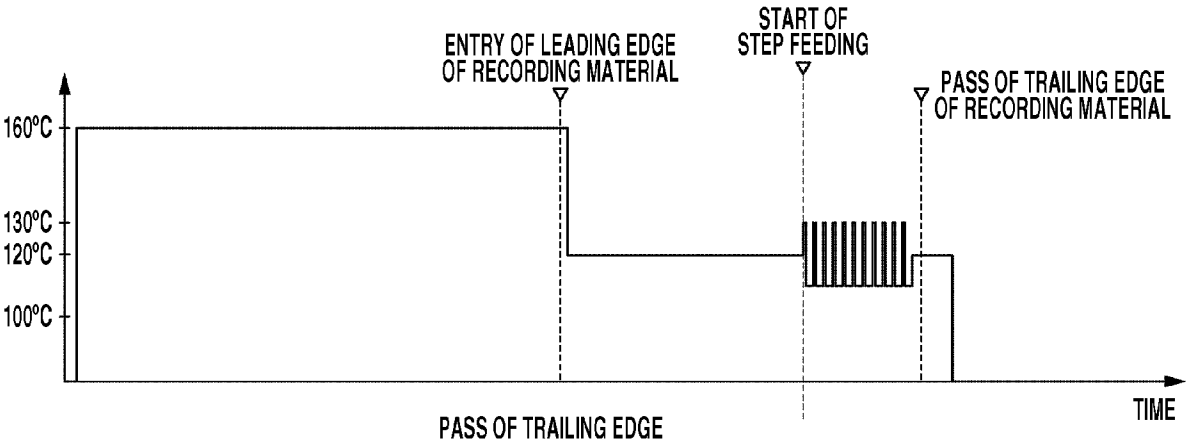
FIGS. 3A and 3B illustrates a cleaning mode according to the first exemplary embodiment of the present invention.
Figure 3B:
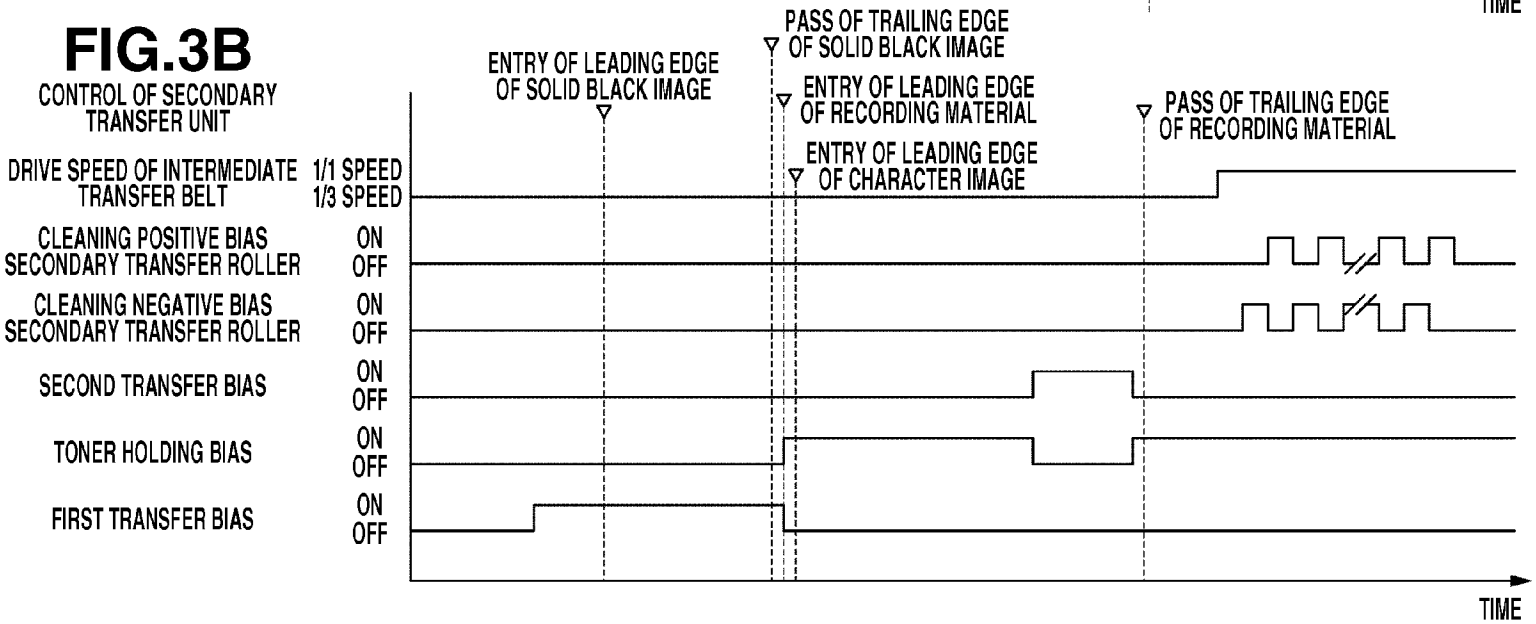

The cleaning mode for cleaning the pressure roller 1 according to the first exemplary embodiment will be described in detail with reference to FIGS. 3A and 3B. First, the surface temperature of the pressure roller 1 is cooled to at least a temperature around a room temperature by leaving the image forming apparatus P until the detection temperature of the thermistor reaches the room temperature. By cooling the temperature of the pressure roller 1 to a temperature around the room temperature, it is possible to prevent the unfixed toner borne by the surface of the sheet 18 that in contact with the pressure roller 1 from being offset to the pressure roller 1 when the sheet 18 is conveyed in a sandwiched state during a process that will be described below.

Next, the pressure roller 1 is rotated for 60 seconds, at a first adjusted temperature (preliminary rotation adjusted temperature) of 170° C., and at the rotational speed of the pressure roller 1 of 120 mm/sec (the full speed). In parallel with this rotation, driving of the intermediate transfer belt 9 is started at a rotational movement speed of 40 mm/sec (the one-third speed). After that, a solid black image is formed on the intermediate transfer belt 9 by the photosensitive drum 4K in such a manner that the solid black image extends by approximately 140 mm (a length corresponding to two times of the outer circumference of the secondary transfer roller 14) in the direction in which the intermediate transfer belt 9 moves (a process direction) and by approximately 200 mm in the direction perpendicular to the process direction. The length of the solid black image in the process direction may be changed according to the transferability from the secondary transfer roller 14 to the sheet 18.

Characters (for example, "CleanIng Page") for indicating that the sheet 18 discharged by the cleaning mode is a cleaning sheet to a user are formed at a position 10 mm away from the trailing edge of the solid black image to the upstream side in the movement direction of the intermediate transfer belt 9. At this time, the sheet 18 to be used as a cleaning sheet is picked up from the sheet feeding cassette 11, and waits in a state sandwiched by the registration roller pair 13.

A voltage having the reverse polarity to the toner is applied as a first transfer bias to the secondary transfer roller 14 by the power source 21. The intermediate transfer belt 9 is moved, and the solid black image formed on the intermediate transfer belt 9 enters the secondary transfer nip portion. Upon the entry into the secondary transfer nip portion, the solid black image is transferred onto the secondary transfer roller 14 with the aid of the first transfer bias applied to the secondary transfer roller 14. In the first exemplary embodiment, the first transfer bias may be changed according to an ambient temperature or an ambient humidity at a location where the image forming apparatus P is set up.

In accordance with the arrival of the trailing edge of the solid black image on the intermediate transfer belt 9 at the secondary transfer nip portion, the sheet 18 is conveyed to the secondary transfer nip portion by the registration roller pair 13. As a result, the solid black image formed on the intermediate transfer belt 9 is transferred onto the secondary transfer roller 14. Then, the above-described characters (for example, "CleanIng Page") for indicating that the sheet 18 is a cleaning paper to a user is in contact with the surface of the sheet 18 that will be in contact with the film 2. At this time, at the timing when the leading edge of the sheet 18 enters the secondary transfer nip portion, a voltage having the reverse polarity to the toner is applied as a toner holding bias to the secondary transfer roller 14 by the power source 21. The toner holding bias may be changed according to the ambient temperature or the ambient humidity at the location where the image forming apparatus P is set up, as is the case with the first transfer bias.

Further, it is desirable that the toner holding bias is a voltage equal to or higher than the first transfer bias, since the toner holding bias is applied in such a state that the sheet 18 is sandwiched between the secondary transfer roller 14 and the intermediate transfer belt 9. The toner transferred to the secondary transfer roller 14 is held on the secondary transfer roller 14 owing to the application of the toner holding bias, while an image such as the above-described characters is transferred to the surface of the sheet 18 that will be in contact with the film 2.

At timing between a time when the leading edge of the sheet 18 passes through the secondary nip portion and a time when the leading edge of the sheet 18 arrives at the fixing nip portion 20, the pressure roller 1 is slowed down. At this time, the rotational speed of the pressure roller 1 is a first driving speed, which corresponds to a process speed of the one-third speed. In other words, the leading edge of the sheet 18, which is entering the fixing nip portion 20 and is being conveyed in a sandwiched state by the fixing nip portion 20, is conveyed at a high speed compared to the rotational movement speed of the intermediate transfer belt 9. More specifically, the leading edge of the sheet 18 is conveyed at a speed corresponding to 103% of the rotational movement speed of the intermediate transfer belt 9. This arrangement is made to prevent dirt of the leading edge and the trailing edge of the sheet 18, which may be otherwise caused due to an attachment of the unfixed toner borne by the surface of the sheet 18 that will be in contact with the pressure roller 1 to the conveyance path during a process that will be described below, by reducing a loop amount of the sheet 18 at the time of the cleaning mode compared to the loop amount at the time of image formation.

At the timing when the leading edge of the sheet 18 enters the fixing nip portion 20, the heater 171 is controlled at a second adjusted temperature (sheet middle temperature adjustment), which is 120° C. The sheet 18 is conveyed in a sandwiched state by the fixing nip portion 20 and the secondary transfer nip portion, and the leading edge of the sheet 18 moves by approximately 200 mm from the entry into the secondary transfer nip portion. At this timing, a voltage having the same polarity as the toner is applied as a second transfer bias to the secondary transfer roller 14 by the power source 21.

In the first exemplary embodiment, the second transfer bias may be changed according to the ambient temperature or the ambient humidity at the location where the image forming apparatus P is set up, as is the case with the first transfer bias. As a result, the toner held on the secondary transfer roller 14 can be transferred to the surface of the sheet 18 that will be in contact with the pressure roller 1. The second transfer bias keeps being applied until the trailing edge of the sheet 18 reaches a position 10 mm before the end of the secondary transfer nip portion. After the stop of the application of the secondary transfer bias, application of the toner holding bias is started again and is continued until the sheet 18 passes the secondary transfer nip portion.

After the trailing edge of the sheet 18 passes the secondary transfer nip portion, an operation for cleaning the secondary transfer roller 14 is performed. The operation for cleaning the secondary transfer roller 14 after the execution of the pressure roller cleaning operation is performed for a long time compared to the above-described normal secondary transfer roller cleaning operation. More specifically, a voltage having positive polarity and a voltage having negative polarity (bipolar voltages) are alternately applied to the secondary transfer roller 14 by the power source 21, thereby discharging the toner attached to the secondary transfer roller 14 and the toner with its polarity reversed. The applied voltages are +1000 V and −1000 V. The polarity of the applied voltage is reversed in synchronization with the rotation cycle of the secondary transfer roller 14. During the secondary transfer roller cleaning operation after the execution of the pressure roller cleaning operation, the rotational movement speed of the intermediate transfer belt 9 is increased to reach the process speed of the full speed, and the polarity of the voltage applied to the secondary transfer roller 14 is reversed 60 times.

At the timing when the trailing edge of the sheet 18 passes the secondary transfer nip portion, the rotation driving of the pressure roller 1 is stopped, and step feeding, which will be described below, is performed. The step feeding is a process for sandwiching the sheet 18 by the fixing nip portion 20 formed by the film 2 and the pressure roller 1, and conveying the sheet 18 while repeatedly driving and stopping a rotation of the pressure roller 1. During the step feeding process, the pressure roller 1 is driven to be rotated for 100 milliseconds, and the distance by which the sheet 18 is conveyed at this time is approximately 5 mm. The pressure roller 1 is stopped for 5 seconds.

When the rotation is stopped, the heater 171 is controlled at a third adjusted temperature 130° C. (step high temperature adjustment), and a fourth adjusted temperature 100° C. (step low temperature adjustment). The step high temperature adjustment is continued for 1200 milliseconds. The step low temperature adjustment is continued for 3800 milliseconds. This control can fuse the surface of the dirt accumulated on the pressure roller 1 by the step high temperature adjustment together with the unfixed toner borne by the surface of the sheet 18 that is in contact with the pressure roller 1, and fix the dirt to the sheet 18 by the step low temperature adjustment. The dirt on the pressure roller 1, which is now fixed to the surface of the sheet 18 that is in contact with the pressure roller 1, is removed from the surface of the pressure roller 1 by the next step feeding.

As described above, the cleaning mode performed by the first exemplary embodiment can provide a sufficient cleaning performance and maintain excellent usability, even when the image forming apparatus P does not have the automatic two-sided printing function, according to which a sheet is turned over within the image forming apparatus P and then is conveyed to the transfer unit to realize two-sided printing.

A second exemplary embodiment will be described. The second exemplary embodiment of the present invention will be described, mainly focusing on differences from the first exemplary embodiment. The features of the second exemplary embodiment that will not be especially described below are similar to the features of the first exemplary embodiment, whereby redundant descriptions thereof will be avoided.

In the second exemplary embodiment, the outer circumference of the secondary transfer roller 14 is shorter than the outer circumference of the pressure roller 1, unlike the first exemplary embodiment. In the second exemplary embodiment, the secondary transfer roller 14 is constituted by a stainless-steel core having an outer diameter of 6 mm, and a NBR hydrin rubber disposed around the core. The NBR hydrin rubber has a thickness of 6 mm. The outer diameter of the secondary transfer roller 14 is 18 mm. Therefore, a problem in this case is that, if the length of the cleaning toner image transferred to the sheet 18 is the same as the outer circumference of the secondary transfer roller 14, the cleaning toner image cannot be in contact with a part of the entire circumference of the pressure roller 1.

If the difference is not so large between the outer circumference of the secondary transfer roller 14 and the outer circumference of the pressure roller 1, in most cases, this difference raises no problem practically. The area in the outer circumference of the pressure roller 1 that the cleaning toner image contacts is not necessarily the same every time. Therefore, even when a part of the outer circumferential surface of the pressure roller 1 cannot be sufficiently cleaned and remain contaminated, the dirt of this part can be removed by execution of the cleaning mode next time or thereafter.

Figure 4A:
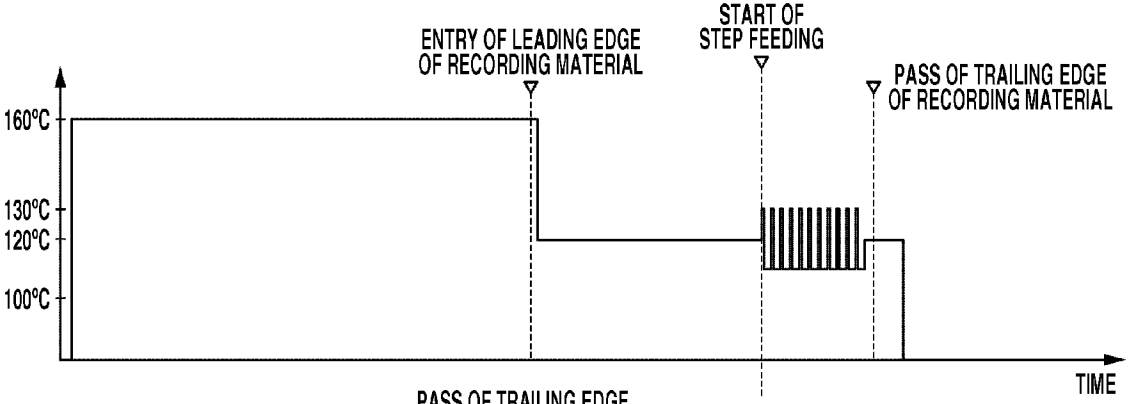
FIGS. 4A and 4B illustrates a cleaning mode according to a second exemplary embodiment of the present invention.
Figure 4B:
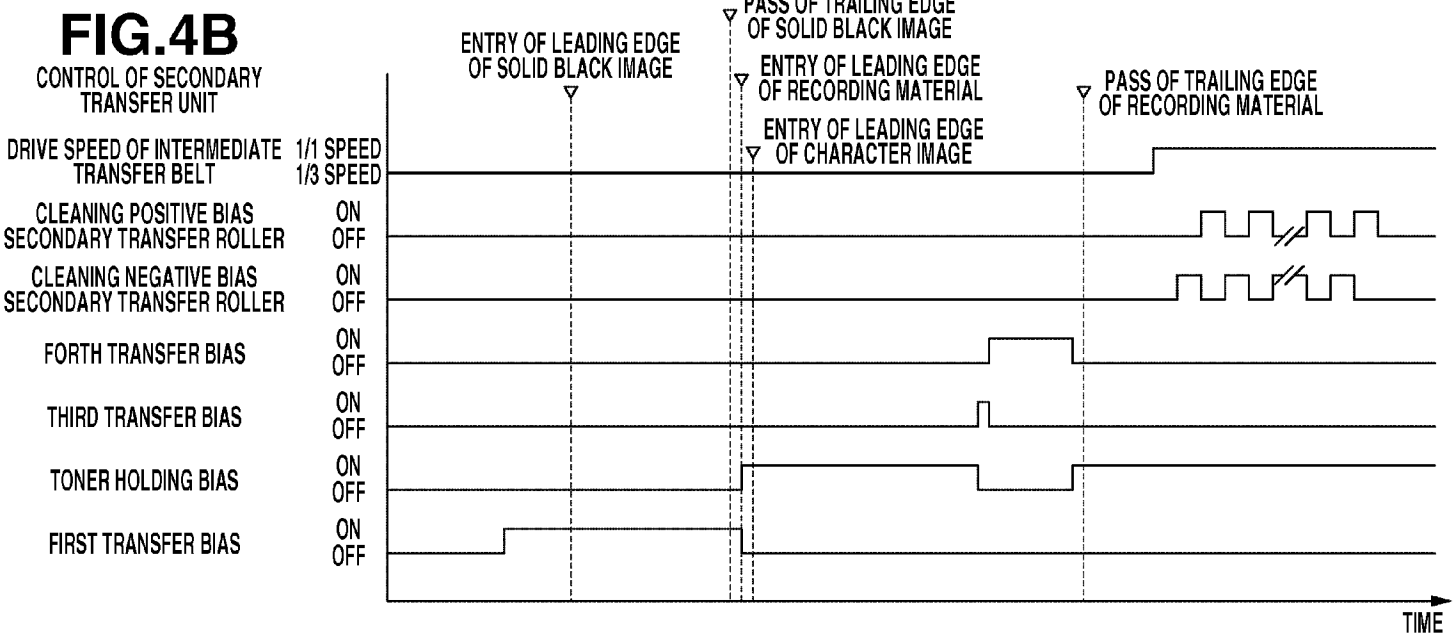

However, in the configuration according to the second exemplary embodiment, in a case where the pressure roller 1 should be cleaned along the entire circumference thereof by one execution of the cleaning mode, the control of the bias for transferring the solid black image transferred to the secondary transfer roller 14 to the sheet 18 is changed from the control according to the first exemplary embodiment. This pressure roller cleaning mode will be described with reference to FIGS. 4A and 4B.

In the second exemplary embodiment, the bias at the time of transfer from the secondary transfer roller 14 to the surface of the sheet 18 that will be in contact with the pressure roller 1 is switched in a stepwise manner during the transfer. In this way, the length of the cleaning toner image transferred to the surface of the sheet 18 that will be in contact with the pressure roller 1 can be increased to be equal to or longer than the outer circumference of the pressure roller 1.

For example, the applied bias is switched using two types of transfer biases, a third transfer bias and a fourth transfer bias as the bias for the transfer from the secondary transfer roller 14 to the surface of the sheet 18 that will be in contact with the pressure roller 1. The absolute value of the third transfer bias is set to become smaller than the absolute value of the fourth transfer bias. The third and fourth transfer biases may be changed according to the ambient temperature or the ambient humidity at the location where the image forming apparatus P is set up, as is the case with the first exemplary embodiment.

The third transfer bias is applied at the timing when the leading edge of the sheet 18 moves by approximately 200 mm after the leading edge of the sheet 18 enters the secondary transfer nip portion, as is the case with the first exemplary embodiment. The bias is switched from the third transfer bias to the fourth transfer bias at the timing when the leading edge of the sheet 18 moves by approximately 210 mm after the leading edge of the sheet 18 enters the secondary transfer nip portion.

According to the second exemplary embodiment, setting two transfer biases enables the cleaning toner image equal to or longer than the outer circumference of the secondary transfer roller 14 to be transferred to the surface of the sheet 18 that will be contact with the pressure roller 1, although the density is not uniform. As a result, it is possible to clean the entire circumference of the pressure roller 1 even when the outer circumference of the secondary transfer roller 14 is shorter than the outer circumference of the pressure roller 1, like the second exemplary embodiment.

In this way, the pressure roller cleaning mode according to the second exemplary embodiment enables the entire circumference of the pressure roller 1 to be effectively cleaned even when the outer circumference of the secondary transfer roller 14 is shorter than the outer circumference of the pressure roller 1. Other advantageous effects by the second exemplary embodiment are similar to the advantageous effects by the first exemplary embodiment, and therefore the descriptions thereof will be omitted here.

Figure 5:
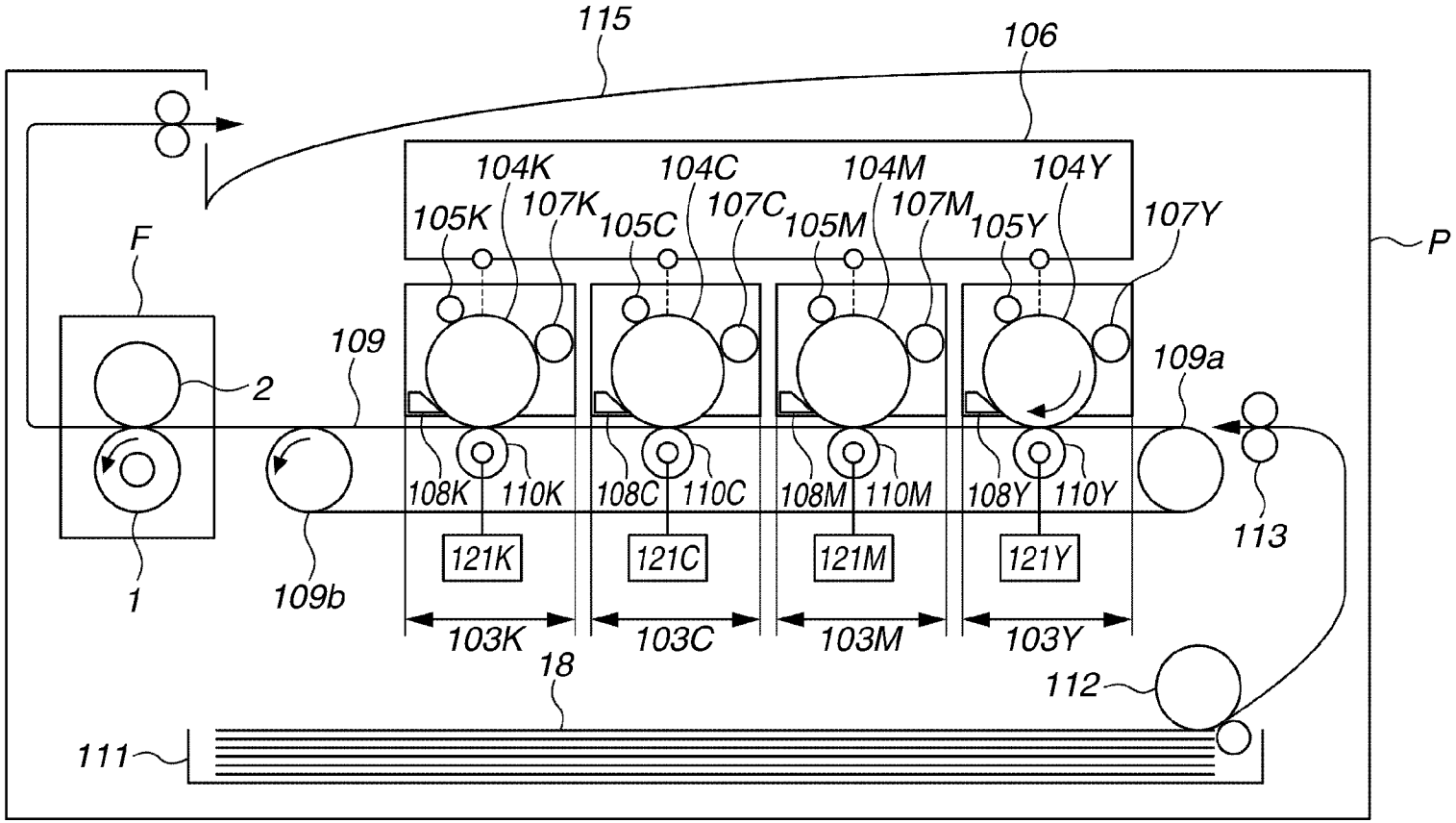
FIG. 5 illustrates an image forming apparatus according to a third exemplary embodiment of the present invention.

A third exemplary embodiment will be described. An image forming apparatus used in the third exemplary embodiment will be described. FIG. 5 illustrates the image forming apparatus P used in the third exemplary embodiment. The image forming apparatus P according to the third exemplary embodiment includes four image forming stations 103Y, 103M, 103C, and 103K, which are substantially linearly arranged. Among the four image forming stations 103Y, 103M, 103C, and 103K, the image forming station 103Y forms a yellow (hereinafter abbreviated as "Y") image. The image forming station 103M forms a magenta (hereinafter abbreviated as "M") image. The image forming station 103C forms a cyan (hereinafter abbreviated as "C") image. The image forming station 103K forms a black (hereinafter abbreviated as "K") image.

The image forming stations 103Y, 103M, 103C, and 103K include drum-type electrophotographic photosensitive members (hereinafter referred to as "photosensitive drums") 104Y, 104M, 104C, and 104K as an image bearing member, and charging rollers 105Y, 105M, 105C, and 105K as a charging unit, respectively. Further, the image forming stations 103Y, 103M, 103C, and 103K include an exposure device 106 as an exposure unit, development devices 107Y, 107M, 107C, and 107K as a development unit, and cleaning devices 108Y, 108M, 108C, and 108K as a photosensitive drum cleaning unit.

When an image is formed, at the image forming station 103Y, the photosensitive drum 104Y is rotated in the direction indicated by the arrow. First, the outer circumferential surface (surface) of the photosensitive drum 104Y is uniformly charged by the charging roller 105Y, and an electrostatic latent image is formed by illuminating the charged surface of the surface of the photosensitive drum 104Y with laser light according to image information by the exposure device 106. This latent image is visualized as a Y toner image by the development device 107Y with use of Y toner. As a result, a Y toner image is formed on the surface of the photosensitive drum 104Y.

A similar image formation process is also performed at the image forming stations 103M, 103C, and 103K. As a result, an M toner image is formed on the surface of the photosensitive drum 104M, a C toner image is formed on the surface of the photosensitive drum 104C, and a K toner image is formed on the surface of the photosensitive drum 104K. In the third exemplary embodiment, the photosensitive drums 104Y, 104M, 104C, and 104K are negatively chargeable organic photo conductors, and toner used in the present exemplary embodiment is toner having negative polarity.

A sheet conveyance belt 109, as a rotatable transfer unit disposed along the direction in which the image forming stations 103Y, 103M, 103C, and 103K are arranged, is stretched by a driving roller 109*a* and a driven roller 109*b*. The driving roller 109*a* rotates in the direction indicated by the arrow in FIG. 5. Above configuration causes the sheet conveyance belt 109 to be rotated and conveyed at a process speed along the image forming stations 103Y, 103M, 103C, and 103K.

Transfer rollers 110Y, 110M, 110C, and 110K as a transfer member are disposed at positions opposite to the photosensitive drums 104Y, 104M, 104C, and 104K inside the sheet conveyance belt 109, respectively, thereby forming transfer nip portions. Power sources 121Y, 121M, 121C, and 121K, which can apply bipolar voltage (both positive and negative), are connected to the respective transfer rollers 110Y, 110M, 110C, and 110K.

The length of the outer circumference of the sheet conveyance belt 109 is approximately 560 mm. The sheet conveyance belt 109 is made of a polyvinylidene fluoride (PVDF) material having a thickness of approximately 100 μm. The volume resistivity of the sheet conveyance belt 109 is approximately $5\times10^{10}$ Ωcm.

Each of the transfer rollers 110 is constituted by a stainless-steel core having an outer diameter of 6 mm, and a foamed rubber formed around the core. The foamed rubber is made of a NBR hydrin material having a thickness of 4 mm. The resistance value of the transfer rollers 110 is $5\times10^{7}$Ω when a voltage of 1 kV is applied while it is pressed against an aluminum cylinder having a diameter of 30 mm, which is rotating at a speed of 30 rpm by a pressure of 1 kgf. Each of the transfer rollers 110 is driven to be rotated by the sheet conveyance belt 109, which is rotated and conveyed by being driven by the driving roller 109*a*.

In the meantime, sheets 18 stacked and contained in a sheet feeding cassette 111 disposed at the lower portion of the image forming apparatus P is separated to be fed one by one from the sheet feeding cassette 111 by a sheet feeding roller 112, and are fed to a registration roller pair 113. The registration roller pair 113 conveys the sheet 18 onto the sheet conveyance belt 109 in synchronization with toner images formed on the photosensitive drums 104. The toner images of the respective colors are transferred to be sequentially superimposed on the sheet 18, which is sucked onto the sheet conveyance belt 109 to be conveyed along it, by the four photosensitive drums 104Y, 104M, 104C, and 104K. As a result, a full-color toner image is transferred onto the sheet 18.

Transfer remaining tonner, which remains on the surfaces of the photosensitive drums 104Y, 104M, 104C, and 104K after the transfer onto the sheet 18, is removed by not-illustrated cleaning blades disposed at the cleaning devices 108Y, 108M, 108C, and 108K. In this way, the photosensitive drums 104Y, 104M, 104C, and 104K become ready for the next image formation.

After that, the sheet 18 bearing the unfixed toner is conveyed to the fixing unit F. The sheet 18 is heated and pressed at the fixing unit F, by which the toner image is heated and fixed onto the sheet 18. The conveyance distance between the transfer nip portion and the fixing nip portion 20 is approximately 80 mm at the black image forming station 103K. After that, the sheet 18 is discharged from the fixing unit F to a discharge tray 115 outside the image forming apparatus (printer) P. The fixing unit F in the third exemplary embodiment is similar to the fixing unit Fin the first exemplary embodiment, and therefore the description thereof will be omitted here.

A pressure roller cleaning mode according to the third exemplary embodiment will be described with reference to FIGS. 6A and 6B. First, the surface temperature of the pressure roller 1 is cooled to at least a temperature around the room temperature by leaving the image forming apparatus P until the detection temperature of the thermistor reaches the room temperature. Next, the pressure roller 1 rotates for 60 seconds, at the first adjusted temperature (preliminary rotation adjusted temperature) of 170° C., and at the rotational speed of the pressure roller 1 of 120 mm/sec (the full speed).

In parallel with above processing, driving of the sheet conveyance belt 109 is started at a rotational movement speed of 40 mm/sec (the one-third speed). A voltage having the reverse polarity of the toner is applied as a normal transfer bias to each of the transfer rollers 110 by the power source 121. After that, a solid black image is formed as a cleaning toner image on the sheet conveyance belt 109 by the photosensitive drum 104K in such a manner that the solid black image extends by approximately 65 mm in the process direction and by approximately 200 mm in the longitudinal direction. In the present exemplary embodiment, the normal transfer bias may be changed according to the ambient temperature or the ambient humidity at the location where the image forming apparatus P is set up.

At this time, during the pressure roller cleaning mode according to the third exemplary embodiment, the sheet 18 to be used as a cleaning sheet is picked up from the sheet feeding cassette 111, and waits in a state sandwiched by the registration roller pair 113.

The sheet conveyance belt 109 is circulated in a state bearing the solid black image on the surface thereof. While the sheet conveyance belt 109 is circulated with the solid black image borne on the surface thereof, a voltage having the same polarity as the toner is applied as a reverse transfer bias to each of the transfer rollers 110. In the third exemplary embodiment, the reverse transfer bias may be changed according to the ambient temperature or the ambient humidity at the location where the image forming apparatus P is set up. The registration roller pair 113 conveys the sheet 18 so that the position 220 mm away from the leading edge of the sheet 18 matches the leading edge of the solid black image on the sheet conveyance belt 109 at the transfer nip portion of the yellow image forming station 103Y.

As a result, the solid black image formed on the sheet conveyance belt 109 can be transferred onto the surface of the sheet 18 that will be in contact with the pressure roller 1. The application of the reverse transfer bias is continued until the trailing edge of the sheet 18 reaches a position approximately 10 mm before the end of the transfer nip portion at the each of the image forming stations 103Y, 103M, 103C, and 103B. After the stop of the application of the reverse transfer bias, the application of the normal transfer bias is started again and is continued until the sheet 18 passes the transfer nip portion.

After the trailing edge of the sheet 18 passes the transfer nip portion at the black image forming station 103K, an operation for cleaning the sheet conveyance belt 109 is performed.

At the timing between a time when the leading edge of the sheet 18 passes through the transfer nip portion at the black image forming station 103K and a time when the leading edge of the sheet 18 arrives at the fixing nip portion 20, the rotational speed of the pressure roller 1 is set to the first driving speed, which corresponds to a process speed of the one-third speed. In other words, the leading edge of the sheet 18, which enters the fixing nip portion 20 and is being conveyed in a sandwiched state by the fixing nip portion 20, is conveyed at a high speed compared to the rotational movement speed of the sheet conveyance belt 109. More specifically, the leading edge of the sheet 18 is conveyed at a speed corresponding to 103% of the rotational movement speed of the sheet conveyance belt 109. This arrangement is made to prevent dirt of the leading edge and the trailing edge of the sheet 18, which may be otherwise caused due to an attachment of the unfixed toner borne by the back surface of the sheet 18 to the conveyance path during a process that will be described below, by reducing a loop amount of the sheet 18.

At the timing when the leading edge of the sheet 18 enters the fixing nip portion 20, the ceramic heater 171 is controlled at the second adjusted temperature (sheet middle temperature adjustment) of 120° C. At the timing when the trailing edge of the sheet 18 passes the transfer nip portion of the black image forming station 103K, the rotation driving of the pressure roller 1 is stopped, and the step feeding is performed. The control during the step feeding is similar to the control according to the first exemplary embodiment, and therefore the description thereof will be omitted here.

As described above, during the cleaning mode according to the third exemplary embodiment, the cleaning toner image formed on the photosensitive drum 104 as the image bearing member is first transferred to the sheet conveyance belt 9, and then is transferred to the surface of the sheet 18 that will be in contact with the pressure roller 1 after the circulation. As a result, in a similar manner to the pressure roller cleaning mode of the image forming apparatus P using the intermediate transfer member described in the description of the first exemplary embodiment, it is possible to form the cleaning toner image on the surface of the sheet 18 that will be in contact with the pressure roller 1, thereby realizing effective cleaning of the dirt on the pressure roller 1. Other advantageous effects by the third exemplary embedment are similar to the advantageous effects by the first exemplary embodiment.

The first to third exemplary embodiments have been described using the image forming apparatus P including the fixing unit F based on the film heating method, as exemplary embodiments of the present invention. However, the pressure roller cleaning mode of the present invention is not limited to a fixing unit based on the film heating method, but can effectively work even for dirt on a pressure roller of a fixing unit based on the heat roller method.

Further, the first to third exemplary embodiments have been described based on the image forming apparatus P in which the pressure member is driven to be rotated, and the heating member is rotated according to the driven rotation of the pressure member, as exemplary embodiments of the present invention. However, the pressure roller cleaning mode of the present invention can effectively work even for an image forming apparatus in which the heating member is driven to be rotated, and then the pressure member is rotated according to the driven rotation of the heating member, or an image forming apparatus in which the heating member and the pressure member are driven to be rotated independently of each other.

Further, the respective exemplary embodiments have been described based on the image forming apparatus P employing the intermediate transfer member 9 (the first and second exemplary embodiments) or the image forming apparatus P employing the sheet conveyance belt 109 (the third exemplary embodiment). However, the pressure roller cleaning mode of the present invention can also work effectively for an image forming apparatus having both an intermediate transfer member and a sheet conveyance belt, or a monochromatic image forming apparatus having a photosensitive drum (image bearing member) and a transfer roller (transfer unit).

Further, the respective exemplary embodiments have been described using the solid black image as the cleaning toner image, as exemplary embodiments of the present invention. However, not only a black image but also another color image can be effectively used as the cleaning toner image. Further, in some cases, a halftone image may be used instead of a solid black image. Further, the cleaning toner image may be constituted by a plurality of colors, instead of a single color.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-180547 filed Aug. 22, 2011, which is hereby incorporated by reference herein in its entirety.

What is claimed is:

1. An image forming apparatus configured to form a toner image on a sheet, the image forming apparatus comprising:

an image forming unit configured to form an unfixed toner image on the sheet; and a fixing unit configured to fix the unfixed toner image on the sheet by heating the sheet bearing the unfixed toner image while conveying the sheet at a fixing nip portion, wherein the image forming apparatus can perform a cleaning mode for cleaning the fixing unit by conveying a sheet with an unfixed toner image for cleaning formed thereon by the fixing nip portion and an image formation mode, not including the cleaning mode, for forming the toner image on the sheet, wherein the image forming unit is configured, at a time of the image formation mode, to form the unfixed toner image on a first sheet surface, and wherein the image forming unit is configured, at a time of the cleaning mode, to form the unfixed toner image for cleaning on a second sheet surface, opposite to the first sheet surface, without reversing the sheet surface toward the image forming unit.

2. The image forming apparatus according to claim 1, wherein the unfixed toner image for cleaning is a solid image.

3. The image forming apparatus according to claim 1, wherein the image forming apparatus includes a toner cartridge detachably attached to the image forming apparatus, and wherein the image forming apparatus performs the cleaning mode when a new toner cartridge is installed on the image forming apparatus.

4. The image forming apparatus according to claim 1, wherein at the time of the cleaning mode the image forming apparatus does not form the toner image on the first sheet surface.

5. The image forming apparatus according to claim 1, wherein at the time of the cleaning mode the image forming apparatus performs step feeding in which a conveyance of the sheet and a stop of the conveyance are repeated at the fixing nip portion.

6. The image forming apparatus according to claim 1, wherein the image forming unit includes an image bearing member configured to bear the unfixed toner image and a transfer rotator that forms a transfer nip portion together with the image bearing member, and wherein the image forming unit transfers the unfixed toner image for cleaning from the image bearing member to the transfer rotator and subsequently transfers the unfixed toner image for cleaning from the transfer rotator to the sheet.

7. The image forming apparatus according to claim 6, wherein the fixing unit includes a first fixing member in contact with the unfixed toner image, which has never been heated before entering the fixing nip portion, at the time of the image formation mode and a second fixing member that forms the fixing nip portion together with the first fixing member, wherein the second fixing member is a rotator having an outer circumference longer than the transfer rotator, and wherein the image forming unit is configured, when the unfixed toner image for cleaning is transferred from the transfer rotator to the sheet, to form the unfixed toner image for cleaning having a length in a sheet conveyance direction that is equal to or longer than the outer circumference of the second fixing member on the sheet by adjusting a bias application amount to be applied to the transfer rotator.

8. The image forming apparatus according to claim 1, wherein the fixing unit includes a first fixing member in contact with the unfixed toner image, which has never been heated before entering the fixing nip portion, at the time of image formation mode and a second fixing member that forms the fixing nip portion together with the first fixing member.

9. The image forming apparatus according to claim 8, wherein the first fixing member is a tubular film, wherein the fixing unit includes a heater in contact with an inner surface of the film.

10. The image forming apparatus according to claim 9, wherein the heater forms the fixing nip portion together with the second fixing member via the film.

11. An image forming apparatus configured to form a toner image on a sheet, the image forming apparatus comprising:

an image forming unit configured to form an unfixed toner image on the sheet; and a fixing unit configured to include a first fixing member and a second fixing member forming a fixing nip portion together with the first fixing member and configured to fix the unfixed toner image on the sheet by heating the sheet with the unfixed toner image formed thereon while conveying the sheet at the fixing nip portion, wherein the image forming apparatus can perform a cleaning mode for cleaning the fixing unit by conveying a sheet with an unfixed toner image for cleaning at the fixing nip portion and an image formation mode, not including the cleaning mode, for forming the toner image on the sheet, and wherein the unfixed toner image, which has never been unheated before entering the fixing nip portion, on the sheet at a time of the image formation mode is in contact with the first fixing member at the fixing portion, and an unfixed toner image, which has never been heated before entering the fixing nip portion, for cleaning on the sheet at a time of the cleaning mode is in contact with the second fixing member at the fixing nip portion.

12. The image forming apparatus according to claim 11, wherein the unfixed toner image for cleaning is a solid image.

13. The image forming apparatus according to claim 11, wherein the image forming apparatus includes a toner cartridge detachably attached to the image forming apparatus, and wherein the image forming apparatus performs the cleaning mode when a new toner cartridge is installed on the image forming apparatus.

14. The image forming apparatus according to claim 11, wherein at the time of the cleaning mode the image forming apparatus does not form the toner image on a sheet surface opposite to a sheet surface where the unfixed toner image for cleaning is formed.

15. The image forming apparatus according to claim 11, wherein at the time of the cleaning mode the image forming apparatus performs step feeding in which a conveyance of the sheet and a stop of the conveyance are repeated at the fixing nip portion.

16. The image forming apparatus according to claim 11, wherein the image forming unit includes an image bearing member configured to bear the unfixed toner image and a transfer rotator forming a transfer nip portion together with the image bearing member, and wherein at the time of the cleaning mode the image forming unit transfers the unfixed toner image for cleaning from the image bearing member to the transfer rotator and subsequently transfers the unfixed toner image for cleaning from the transfer rotator to the sheet.

17. The image forming apparatus according to claim 16, wherein the second fixing member is a rotator having an outer circumference longer than the transfer rotator, and wherein the image forming unit is configured, when the unfixed toner image for cleaning is transferred from the transfer rotator to the sheet, to form the unfixed toner image for cleaning having a length in a sheet conveyance direction that is equal to or longer than the outer circumference of the second fixing member on the sheet by adjusting a bias application amount to be applied to the transfer rotator.

18. The image forming apparatus according to claim 11, wherein the fixing unit includes a heater that heats the first fixing member.

19. The image forming apparatus according to claim 11, wherein the first fixing member is a tubular film, wherein the fixing unit includes a heater in contact with an inner surface of the film, and wherein the heater forms the fixing nip portion together with the second fixing member via the film.

20. The image forming apparatus according to claim 19, wherein the heater forms the fixing nip portion together with the second fixing member via the film.

21. An image forming apparatus configured to form a toner image on a sheet, the image forming apparatus comprising:

an image forming unit configured to form an unfixed toner image on the sheet while conveying the sheet at a transfer nip portion, the image forming unit includes a first image bearing member and a second image bearing member forming the transfer nip portion by contacting the first image bearing member; and a fixing unit configured to fix the unfixed toner image on the sheet by heating the sheet bearing the unfixed toner image while conveying the sheet at a fixing nip portion, wherein the image forming apparatus can perform a cleaning mode for cleaning the fixing unit by conveying a sheet with an unfixed toner image for cleaning at the fixing nip portion and an image formation mode, not including the cleaning mode, for forming the toner image on the sheet, and wherein the image forming unit, at the time of the image formation mode, transfers the unfixed toner image from the first image bearing member to the sheet, and the image forming unit, at the time of the cleaning mode, transfers the unfixed toner image from the second image bearing member to the sheet.

22. The image forming apparatus according to claim 21, wherein the image forming unit, at the time of the cleaning mode, transfers the unfixed toner image for cleaning from the first image bearing member to the second image bearing member and subsequently transfers the unfixed toner image for cleaning from the second image bearing member to the sheet.

* * * * *